US006604741B1

(12) United States Patent
Snow

(10) Patent No.: US 6,604,741 B1
(45) Date of Patent: Aug. 12, 2003

(54) SPLIT CARD FEATURE DURING CONTINUED PLAY OF BLACKJACK

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 10/199,561

(22) Filed: Jul. 19, 2002

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS 4,861,041 A 8/1989 Jones et al. ..... 273/292
5,098,107 A 3/1992 Boylan et al. ..... 273/292
5,413,353 A 5/1995 Demarest et al. ..... 273/292
5,615,888 A * 4/1997 Lofink et al. ..... 273/292
5,660,392 A 8/1997 Hansen ..... 273/292
5,839,730 A 11/1998 Pike ..... 273/292

* cited by examiner

*Primary Examiner*—Benjamin H. Layno
(74) *Attorney, Agent, or Firm*—Mark A. Litman & Assoc. P.A.

(57) ABSTRACT

A novel element in the play of a variant of Blackjack or twenty-One includes allowing a player to split off a single card after taking a hit when the hit card matches an earlier dealt card, such as one or the other of the two first cards in the original hand or another hit card. It is preferred that the game is played so that a single card may be split off after taking a hit when the last hit card of a player matches the value of the previous card dealt to that player. The split off of a card preferably may not be exercised when the player's last hit broke or busted the player's hand.

38 Claims, No Drawings

SPLIT CARD FEATURE DURING CONTINUED PLAY OF BLACKJACK

BACKGROUND OF THE INVENTION

1. Field of the Invention

This invention relates to casino table card games, particularly variations of Blackjack or Twenty-one card games, and a method of playing those game variations.

2. Background of the Art

Blackjack or Twenty-One is a card game that is played on a live casino gaming table, on a video table, on-line through casino/gaming network connections and on a video gaming machine. The most popular method of play is with a live dealer and a number of players (usually up to a maximum of seven because of physical limitations on table size) at a table. Where there are seven player stations, each of the stations or positions is equally spaced around the tabletop. The dealer is positioned at one side of the table and players are positioned at an opposite, arcuate edge of the table, which is approximately semicircular in its most common form. A wagering area for placement of wagers and for receiving cards is provided at each player position, usually in the form of a printed circle identifying where wagers or cards are to be placed. To begin play of the games of Blackjack or Twenty-One, the dealer is provided with one or more (typically 1, 2, 6 or 8 decks) shuffled decks of cards. These decks may now be continuously shuffled to provide an unlimited supply of cards. These may be standard playing card decks, or modified decks according to the rules of particular games. A player places money or chips to identify the size of a wager to enter the game. Upon placement of a wager by players, the dealer provides each player that has made a wager with two initial cards. These cards may be provided with both cards face down, one card face down and another face-up, or with both cards face-up. The degree of display of a player's hand (in a casino version of the game where players compete with a dealer) has no consequence or influence on the play or outcome of the game. This is the player's preliminary hand. At or about the same time, the dealer is also provided with two cards (with one card shown face-up).

The player evaluates the player's initial hand, and where a dealer's card is displayed, against the partially revealed dealer's hand. The player then evaluates how the player's hand will be played and how wagering will continue based on the assessment.

In the play of Blackjack or Twenty-One, one or more standard decks of cards typically are used. An ace dealt to a player has a point value of either "1" or "11" at the election of the player; a face card (jack, queen or king) has a point value of "10" and each of the remaining cards ("2" through "10") have a point value equal to what is alternatively referred to as the numerical face value or number value of the card. Point values of cards held by the player are added together to obtain a player total point value. The suits of cards in a standard blackjack game have no special value and are not used in scoring hands. A dealer total point value is obtained in a similar manner, with an ace required to be a count of eleven when the player's count on a hand would be 17, 18, 19, 20 or 21.

After the wagers are placed within the imprinted circle, the player and the dealer are each dealt a hand comprised of two cards from the same shuffled deck(s). The cards of the player's hand are dealt face-up, partially revealed or face-down. A first (not necessarily first in order of dealing) card of the player's hand is dealt face-down. A second one of the player's hand is dealt face-up.

Whenever the player's face-up card is either an ace or has a point value of "10", the dealer ascertains the point value of the face-down card without revealing it to the player unless the dealer total point value is "21". When the first two cards of the dealer hand cause the dealer total point value to be "21", the dealer is said to have blackjack whereupon the dealer turns the face-down card face up. Under the circumstance of the dealer having a blackjack, the dealer wins against all players, except those who also have a blackjack, where a push or tie is declared. Similarly, when the two cards of the player hand causes the player total point value to be "21", the player is said to have blackjack, and that player immediately wins against the dealer, unless the dealer also has a two-card hand point count of 21, another blackjack.

When the dealer has blackjack, the dealer wins the wager with two exceptions. A first exception occurs when the dealer's face up card is an ace and the player places a separate and additional wager (up to a maximum of one-half the amount of the initial game wafer) representing an insurance bet. When the dealer does not have blackjack, the player loses the insurance bet. When the dealer has blackjack, the insurance wager is paid off to the player as 2:1 and the insurance bet is returned to the player.

The second exception to the dealer winning with a blackjack occurs when the player also has blackjack. In that case, the player's wager is a push, and is returned to the player. The second exception is just one example of when the player hand and the dealer hand have the same total point value and is referred to as a push or tie.

When the player has a blackjack and the dealer does not, the player wins the wager. When neither the dealer nor the player has blackjack, the player then has four options. A first option is to have the count of the player's hand augmented by at least one additional card (referred to as a "hit"). The player may elect to have successive hits until the player total point value reaches a point count where the player wants to stay or where the count exceeds "21" and the player has broken or busted. When the total point value of a hand exceeds "21" it is said to bust or break. The player loses the wager when the player hand busts. Therefore, busting or breaking is a catastrophic termination of play of the player.

A second option is not to have the player hand augmented by any additional cards (referred to as a "stand"). The player may elect stand at any time that the player hand has not busted, including with the initial two-card hand dealt to the player at the beginning of the game.

A third option, referred to as doubling down, permits the player to double the wager and receive one additional card. For example, if the player has a point count where no card dealt to the player would cause the hand to break, and the dealer displays a weak card (e.g., 2, 3, 4, 5 or 6) as the expose card, the player may double the initial wager and limit hits to a single card. This is ordinarily done when the player's initial count in the first two cards are 9, 10 or 11.

A fourth option is available when the player's initial hand is comprised of two cards that are a pair or of the same point count (e.g., such as a pair of nines, or each of the two cards has a value of '10', a 10 and a jack, or a pair of queens, for example). The player may split the pair into first and second player hands. An additional card is dealt to the first player hand (which is then played as a regular hand, with similar options as described above being available in the play of the first split hand). After play has been concluded with the first split hand, a card is dealt to the second split card to form the second player hand. The second split hand is then played to conclusion in the manner of a regular Blackjack hand or Twenty-One hand. In most casinos, the player is given the added opportunity of creating even more hands by splitting if either or both of the second two cards dealt to the player also has the same number count as the split pair of cards. There is normally a limit of 3 or 4 total hands that may be created by splitting cards, however, the number of splits possible may be any amount desired by the house. There may also be rules that aces can be split only once and that aces may receive only a single card (no subsequent hits) when aces are split from the initial hand.

The decision to hit or stand is made with an objective of causing the player total point value to be closer to "21" than the dealer total point value without busting. It should be understood that central factors in making the decision are the dealer's face-up card and the player's two-card total point value.

After all of the players stand the dealer's face-down card is turned face-up, whereby both cards of the dealer hand are face-up. When the dealer's total point value is less than "17," the dealer must hit until the dealer total point value is at least "17." When a hit causes the dealer hand to bust and the player hand has not busted, the player wins the wager. A 'soft' 17, (where a player's ace counted as 11 contributes to the point total of 17), may be hit again at the option of house rules. It should be understood that when the dealer's initial hand includes an ace and a six, for example, it is referred to as a soft "17" because the ace causes the exemplary hand to have alternative point values of "7" and "17". Usually, the dealer hand cannot be hit when it is the soft "17".

When neither the player hand nor the dealer hand busts and the dealer total point value exceeds the player total point value, the dealer wins and vice versa. When there is a push, there is no winner; the initial wagers representative of the bets are returned to the player. This describes the essentially standard method of play of the game of Blackjack or Twenty-One. As with any form of entertainment, variations, extensions or improvements of the game are often attempted or described.

U.S. Pat. No. 5,839,730 (Pike) describes a method of playing a wagering game that is achieved by providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the game consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand.

Several optional blackjack side wagers have been described. These include the Over/Under 13, Super 7s, Top of the Deck, Royal Match (Boylan et al., U.S. Pat. No. 5,098,107, 1992), and Bust-Out wagers. A separate progressive jackpot wager achieved through a predetermined arrangement of cards also has been proposed (Jones et al., U.S. Pat. No. 4,861,041, 1989).

U.S. Pat. No. 5,413,353 is directed to a method of playing a blackjack-type card game. Each player places an identical dealt into a pot. The dealer deals two cards to each player, but receives no cards himself. The players may split pairs in the initial hand, draw additional cards or stand. The player with the best blackjack hand overall takes the pot. If two or more players tie, the pot is divided or the game is declared a tie and cards are redealt.

In the normal play of Blackjack or Twenty-One, the ability to split cards or form additional hands has been limited to cards of equivalent count dealt in the original or initial player's hand of two cards. Although some discussions, for example the specification of Hansen, U.S. Pat. No. 5,660,392 (column 4, lines 44–56, describe splitting "cards of the same value", this language is believed to refer exclusively to splitting the initial hand of two cards, especially since no rules or guidelines are provided with respect to any other mechanism for forming multiple hands, and it is assumed that the reader understands the standard rules for splitting the initial two-card hand of the player.

SUMMARY OF THE INVENTION

A novel element in the play of a variant of Blackjack or Twenty-One includes allowing a player to split off a single card after taking a hit when the hit card matches an earlier dealt card, such as one or the other of the two first cards in the original hand or a subsequent hit. It is preferred that the game is played so that a single card may be split off after taking a hit when the last hit card of a player matches the value of the previous card dealt to that player. The splitting off of a card preferably may not be exercised when the player's last hit breaks or busts the player's head.

The invention includes a method of playing blackjack that comprises:

a) dealing two cards comprising a first card and a second card to at least one player to form a player's hand;

b) allowing the player to take at least one additional card after receiving the two cards;

c) if any additional card matches a value of previously dealt card in the player's hand, allowing the player to separate the latter additional card into a separate hand for the player.

This separation of the latter card ordinarily does not allow for the separation of the earlier card into a distinct hand. This is a possible option, but could cause the play of the game to become overly complex. There is likely to be a house rule, also, that allows a maximum number of hands (e.g., 2, 3, 4, 5 or 6) to be played by a single player after splitting off cards by any method, including play according to the rules of the present game.

The invention also includes a method of playing blackjack that comprises:

a) dealing two cards comprising a first card and a second card to at least one player;

b) allowing the player to take at least a third card in addition to the two cards;

c) if the last card dealt matches a previously dealt card in the hand, allowing the player to separate the last card dealt into a second hand for the player.

DETAILED DESCRIPTION OF THE INVENTION

The present invention is an alteration in the normal play of Blackjack or Twenty-One which allows players to split-off single cards to form an additional hand when a hit card taken after receipt of the initial two-card hand matches an earlier dealt card (in numerical value) in the player's hand. When that card is split off, the player completes the play of either the original hand or the new split-off hand to completion before playing the other hand. It is preferred that the split-off card should match the last card previously dealt to the player, so that card matches may be split only when consecutively dealt cards to a player's hand match in value. It is also an option to prohibit the splitting-off of cards when the last card breaks the player's hand. Numerous variations in play consistent with the advanced splitting-off feature of the present invention are possible in the play of the game. In contrast, conventional splitting rules allow splitting of only the first two cards dealt.

Examples of the alternative splitting-off step of the present invention are shown in the following analysis. The inventive splitting-off step follows the normal deal of the two card initial player's hand(s). The player may play that hand in the normal manner, including splitting cards of like value and playing multiple hands. The inventive delayed splitting-off feature comes into play after the player begins accepting hits on the initial two card hand or on any two card hand resulting from a previous splitting of cards of like value in the initial two-card hand.

The delayed splitting feature of the present invention is best understood by way of example. When the initial hand constitutes two cards (X is the value of the first card and Y is the value of the second card) of values X and Y, the player may take a hit if desired. The value of the first hit card may be Z (any single value other than X or Y) or may be X or Y. If the value of the card is Z, the point total ($T_{pp}$) of the player's hand is X+Y+Z. If $T_{pp}$ is more than 21, the player's hand has broken or busted. At this point, as in a conventional Blackjack or Twenty-One game, the hand is over for that player. If the Hit card is a card with a value X or Y ($V_{x,y}$), the player may elect to split off the hit card to form an additional hand, if the rules allow for splitting off the hit card if it is the same value as either X or Y. The rules may allow (or not allow) for splitting off the hit card in either event where the sum of $V_{x,y}$+X+Y is less than greater than or equal to 21. It would not typically be optimal game strategy for a player to split-off the hit card if the point total was equal to 21 (which would guarantee at least a push, unless the dealer had a blackjack), but the strategy of a player could call for that move to possibly maximize winnings on the hand. The rules may allow splitting only where the sum of $V_{x,y}$+X+Y is 21 or less, and not allow splitting-off where the sum of $V_{x,y}$+X+Y is greater than 21. These selections are made by the house to adjust the hold maintained by the house or to speed up the game by reducing the number of hands that a player might have.

In other examples of the invention, the hit card W is dealt after $V_{x,y}$ is dealt, and the sum of the point values of all cards dealt prior to W plus the value of W must not exceed 21 in order for the player to split off the W card.

When a player splits off a hit card according to the practice of the invention, the most usual format of play would then be for the dealer to provide that player with one or more hit cards to the first hand, and play that 'first' player's hand to conclusion. Again, the house may vary the rules, but this method or format of play tends to be more consistent with the normal play of split initial two-card hands. The first hand is played to conclusion, with additional in-play splitting off of cards still being allowed, up to any maximum number of total hands for a single player that a house wishes to set on a single hand. After the first hand is played to conclusion, the split-off card is treated as the first card in the play of a second hand with both normal Blackjack or Twenty-One rules applying except that the special in-play splitting-off rules of this invention in operation. It is possible for the house rules to allow the split-off card to be played as a hand before completing play on the original hand from which a card has been split off.

According to the invention, the delayed split feature of the present invention may be combined with conventional splitting rules so that any time a pair is dealt, either consecutively or otherwise, splitting is possible, up to the stated maximum number of permitted splits.

Special rules may also be provided by the house. For example, in a less preferred (by the house) method of play, if the player doubles down and matches one of the cards in the initial two-card hand, the player may split-off the double down hit card, and receive a 'replacement' hit card. This would be a significant advantage to a player, and casinos may not activate this rule, even though it is an option according to the contemplated practice of the invention.

Given these general considerations in the practice of the invention, other rules and considerations of play might also be used. For example, the additional rules or play available might include:

2) a player doubling down on any number of cards (assuming that a double down has not already been made on a previous hit, or even after a double down has been made on a previous hit, the second double down being for the amount of the original wager or the amount of the original wager plus the double down hit),
3) a double down on the first hand and/or second hand after splitting,
4) surrender at any time by breaking a hand, (either hand), after the dealer has confirmed that the dealer does not have a blackjack,
5) any double down may be for less then the wager amount on that hand, and
6) the main new play event of splitting the last received card after receiving a hit that matched an earlier dealt card in value.

Additional rules that can be put into play could be that:

1) a player's blackjack always wins (e.g., 1:1 against a dealer's blackjack),
2) suited blackjacks pay 3:2, and unsuited blackjacks pay 1:1 (thereby balancing the effect of the immediately preceding additional rule 1)),
3) a six-card no bust hand automatically wins (with or without the dealer checking for a dealer's blackjack),
4) when splitting by any mechanism, the maximum number of hands for a player would be 2, 3, 4, 5 or 6,
5) different amounts of wagers (either higher or lower, and possibly dependent upon predetermined events, such as matching identical cards [e.g., two queens of spades, or two kings of any suit], allowing for the player to place different amounts of wagers on the split-off card hand) may be placed on the split off hand than on the originally dealt hand, and
6) split aces may receive only one card, or may be allowed to receive any number of cards the player wishes, until the players stays or breaks. As is standard with splitting aces, counts of 21 received on split aces are not usually considered blackjacks (although with the 1:1 payoff rule, this rule may be waived, if elected by the house).

The following non-limiting examples of play of the game exemplify rules, manners of executing those rules, and options that may be available for play by the players.

EXAMPLE 1

The player receives an initial hand of a 5 (first card) and a 4 (second card). This hand is not usually doubled down according to most preferences. The dealer is showing a 6 on the dealer's initial hand. The first hit card received by the player is a 5. If the rules allow for any card in the initial two-card hand being matched to provide a split-off opportunity, the player might elect to split off the five, as the point count of 14 is not desirable, either for staying or taking a hit. By splitting off the hit card (value of 5), the player has a first hand (still) of a 5 and a 4, and a second hand of only a five. The player would then request another hit on the first hand. Assuming that a nine was received, the player's first hand would be a total count of 18, on which the player would be likely to stay, then proceeding to the second hand. Taking a hit on the second hand, the dealer receives a 6. This is an initial count of 11, and facing a dealer's displayed card of a 6, the player would likely elect to double down. If the hit card on the double down is another six, various rules or variations could come into play. If a double down wager cancels out the matching card splitting off event, then the player must stay with the count of 17. If the double down event does not cancel the matching card splitting-off event, the player may elect to split off the second 6 to form a third hand. The rules may allow for the second hand double down to be (a) withdrawn, (b) continued, or (c) increased by an amount equal to the original wager or the original wager plus the first double down amount. Upon election of one of these options, assuming a splitting-off event for the second 6, the player takes a hit on the original split-off hand and receives a card with a value of 10, giving a count of 21 on the second hand. At this point, the third hand, now having a count of only 6 would be played. If the player then receives a card to complete the initial third hand of a 7, the player would then probably elect to stay. The player at this point would have hands of 18 (first hand), 21 (second hand), and 13 (third hand) against the dealer's up card of a 6. If the dealer turns up the hole card and it is an ace, the player wins the first two hands and loses the third hand for a net gain of one win, and if the second hand had one or more double down wagers, at least two wins.

As can be seen, this method of play provides some simple advantageous strategies for the player.

EXAMPLE 2

The player is given an initial hand of a 7 (first card) and a 3 (second card), and the dealer has a nine as the up card. The player takes a hit and receives another 3 for an intermediate count of 13. This is a disadvantageous position for the player (expecting to either break with another hit or lose to the dealer's better point count, assumed to be 19), who according to the rules of the game would now elect to split-off the second 3, leaving a first hand of again a point count of 10 and the start of a second hand with a count of 3. The player takes a hit and receives a face card for a total count of 20 and would then stay on the first hand. The player then receives a second card on the split-off 3 hand and receives another face card for an initial hand count of 13. The player may elect to stay or take a hit, with the latter usually being the preferred strategy. Upon taking a hit and receiving a card with a value of 4, the player would stay on the second hand with a count of 17. The player displays the hole card as a face card, for a total of 19. The player would therefore win the first hand and lose the second hand. With these cards, and without the option of splitting-off the first 3 hit card, the player would have lost the only hand in play, rather than breaking even on the two hands. In this example of the invention, the matching split cards are consecutively dealt. In the first example, the matching split cards are not consecutively dealt.

In other examples of the invention, the player takes more than one hit, and splitting the last card dealt is permitted, regardless of the number of hits taken. In a preferred form of the invention, the player cannot split to avoid busting. In another preferred form of play, if the player receives four hits for a total of six cards and does not bust, he automatically wins, regardless of the point value of the dealer's hand. In another example, he wins unless the dealer has a blackjack.

The above examples of the splitting feature of the present invention are merely illustrations and other forms of the invention are possible. For example, the present invention also contemplates splitting groups of cards, rather than just the last card dealt.

All of the methods disclosed and claimed herein can be made and executed without undue experimentation in light of the present disclosure. While the methods of this invention have been described in terms of preferred embodiments, it will be apparent to those skilled in the art that variations may be applied to the methods described herein without departing from the concept and scope of the invention. All such similar substitutes and modifications apparent to those skilled in the art are deemed to be within the scope and concept of the invention as defined by the appended claims.

What is claimed:

1. A method of playing blackjack that comprises:

a) dealing two cards comprising a first card and a second card to at least one player to form a player's hand;

b) allowing the player to take at least one additional card after receiving the two cards;

c) if a last additional card dealt matches a value of any previously dealt card, allowing the player to separate the last additional card into a second hand for the player.

2. The method of playing blackjack of claim 1 wherein the player is allowed to separate only the last card when it matches in value an immediately previously dealt card.

3. The method of claim 2 wherein after receiving at least three cards in a player's hand, the player is allowed to double down on existing wagers.

4. The method of claim 2 wherein a player may surrender any hand that has not busted at any time before the dealer takes hits.

5. The method of claim 2 wherein a hand comprising a separated card is completed only after completion of play on earlier hands.

6. The method of playing blackjack of claim 1 wherein the last additional card dealt is an additional card that does not cause total count of the player's hand to exceed twenty-one.

7. The method of playing blackjack of claim 2 wherein the last additional card dealt is an additional card that causes total count of the player's hand to exceed twenty-one.

8. The method of claim 7 wherein a player may surrender any hand that has not busted at any time before the dealer takes hits.

9. The method of claim 7 wherein a hand comprising a separated card is completed only after completion of play on earlier hands.

10. The method of claim 6 wherein a player may surrender any hand that has not busted at any time before the dealer takes hits.

11. The method of claim 6 wherein a hand comprising a separated card is completed only after completion of play on earlier hands.

12. The method of claim 1 wherein after receiving at least three cards in a player's hand, the player is allowed to double down on existing wagers.

13. The method of claim 1 wherein a player may surrender any hand that has not busted at any time before the dealer takes hits.

14. The method of claim 1 wherein a hand comprising a separated card is completed only after completion of play on earlier hands.

15. The method of claim 1 wherein a player's blackjack always wins.

16. The method of claim 15 wherein a player's blackjack is paid at a rate of 1:1.

17. The method of claim 15 wherein a player's blackjack is paid at a rate of 1:1, except where the player's blackjack is a one-suited blackjack, which is paid at a rate of greater than 1:1.

18. The method of claim 1 wherein any player's hand with at least 6 cards and a total of 21 or less always wins, except against a dealer's blackjack.

19. A method of playing blackjack that comprises:

a) dealing two cards consisting of a first card and a second card to at least one player;

b) allowing the player to take at least a third card in addition to the two cards to form a hand;

c) if a last dealt card matches a previously dealt card in the hand, allowing the player to separate the last card into a second hand for the player.

20. The method of playing blackjack of claim 19 wherein the player is allowed to separate only the last card that matches in value an immediately previously dealt card.

21. The method of playing blackjack of claim 20 wherein the last card is an additional card that causes total count of the player's hand to exceed twenty-one.

22. The method of claim 21 wherein a player may surrender any hand that has not busted at any time before the dealer takes hits.

23. The method of claim 21 wherein a hand comprising a separated card is completed only after completion of play on earlier hands.

24. The method of claim 20 wherein after receiving at least three cards in a player's hand, the player is allowed to double down on existing wagers.

25. The method of claim 24 wherein a player's blackjack is paid at a rate of 1:1.

26. The method of claim 24 wherein a player's blackjack is paid at a rate of 1:1, except where the player's blackjack is a one-suited blackjack, which is paid at a rate of greater than 1:1.

27. The method of claim 20 wherein a player may surrender any hand that has not busted at any time before the dealer takes hits.

28. The method of claim 20 wherein a hand comprising a separated card is completed only after completion of play on earlier hands.

29. The method of claim 20 wherein the third card may be separated into a second hand only when it matches the immediately preceding card in the player's hand.

30. The method of playing blackjack of claim 19 wherein the last card is an additional card that does not cause total count of the player's hand to exceed twenty-one.

31. The method of claim 30 wherein a player may surrender any hand that has not busted at any time before the dealer takes hits.

32. The method of claim 30 wherein a hand comprising a separated card is completed only after completion of play on earlier hands.

33. The method of claim 19 wherein after receiving at least three cards in a player's hand, the player is allowed to double down on existing wagers.

34. The method of claim 19 wherein a player may surrender any hand that has not busted at any time before the player takes hits.

35. The method of claim 19 wherein a hand comprising a separated card is completed only after completion of play on earlier hands.

36. The method of claim 19 wherein a player's blackjack always wins.

37. The method of claim 19 wherein any player's hand with at least 6 cards and a total of 21 or less always wins, except against a dealer's blackjack.

38. The method of claim 19 wherein the third card may be separated into a second hand only when it matches the second card in the player's hand.

* * * * *